US008875914B2

(12) United States Patent
Marsollier

(10) Patent No.: US 8,875,914 B2
(45) Date of Patent: Nov. 4, 2014

(54) ANTI-DRIP DEVICE FOR A BOTTLE

(75) Inventor: Patrice Marsollier, Thouare sur Loire (FR)

(73) Assignee: Presticorc, La Chapelle Basse Mer (FR)

( * ) Notice: Subject to any disclaimer, the term of this patent is extended or adjusted under 35 U.S.C. 154(b) by 174 days.

(21) Appl. No.: 13/379,117

(22) PCT Filed: Jun. 17, 2010

(86) PCT No.: PCT/FR2010/051220

§ 371 (c)(1),
(2), (4) Date: Dec. 19, 2011

(87) PCT Pub. No.: WO2010/146317

PCT Pub. Date: Dec. 23, 2010

(65) Prior Publication Data

US 2012/0097633 A1 Apr. 26, 2012

(30) Foreign Application Priority Data

Jun. 19, 2009 (FR) ..... 09 02978

(51) Int. Cl.

| | |
|---|---|
| ***B65D 23/06*** | (2006.01) |
| ***B65D 39/00*** | (2006.01) |
| ***B67D 1/16*** | (2006.01) |
| ***B65D 41/62*** | (2006.01) |

(52) U.S. Cl.

CPC ..... *B65D 23/065* (2013.01); *B65D 41/62* (2013.01)

USPC ..... 215/41; 215/256; 222/108

(58) Field of Classification Search

USPC ..... 215/41, 46, 47, 256, 301–305; 220/695, 220/DIG. 5; 222/108, 571, 228, 355

See application file for complete search history.

(56) References Cited

U.S. PATENT DOCUMENTS

| | | | | | |
|---|---|---|---|---|---|
| 2,014,033 | A | * | 9/1935 | Smith | 215/41 |
| 2,785,841 | A | * | 3/1957 | Westgate | 222/545 |
| 2,796,205 | A | * | 6/1957 | Kuzma | 222/464.1 |
| 2,818,209 | A | * | 12/1957 | Hiesinger et al. | 417/153 |
| 3,926,348 | A | * | 12/1975 | Lutzker | 222/189.07 |
| 6,079,579 | A | * | 6/2000 | De Cuyper | 215/41 |
| 8,205,541 | B2 | * | 6/2012 | Barberio et al. | 99/277.1 |
| 2008/0121607 | A1 | | 5/2008 | Marsollier | |

FOREIGN PATENT DOCUMENTS

| | | | |
|---|---|---|---|
| FR | 941 772 | A | 1/1949 |
| FR | 972 279 | A | 1/1951 |
| FR | 2 877 644 | A1 | 5/2006 |
| GB | 754 582 | A | 8/1956 |

OTHER PUBLICATIONS

International Search Report, dated Nov. 4, 2010, from corresponding PCT application.

* cited by examiner

*Primary Examiner* — Bryon Gehman
*Assistant Examiner* — Shawn M Braden
(74) *Attorney, Agent, or Firm* — Young & Thompson

(57) ABSTRACT

A non-drip device for a bottle is in the form of an outwardly projecting peripheral lip. This peripheral lip has a triangular section of thickness that decreases out to an outer tip, the lip being defined by a top side and by a bottom side that, between them, form an angle lying in the range 5° to 45° . This outwardly projecting peripheral lip has a length advantageously lying in the range 0.1 mm to 0.8 mm. It may be provided at the top end of the skirt of a cover of the engagement type. In a variant embodiment, this lip may be formed integrally at the neck of the bottle. Such a lip structure makes it possible, at the time of pouring, and in effective manner, to avoid formation of drops that run down along the outside face of the bottle.

18 Claims, 3 Drawing Sheets

ANTI-DRIP DEVICE FOR A BOTTLE

BACKGROUND OF THE INENTION

1.Field of the Invention

The present invention relates to non-drip devices for bottles, which devices are adapted to avoid or at least to limit formation of drops that run down along the body of the bottle, on the outside face thereof, after pouring.

2.Description of the Related Art

After pouring out a glass, it is frequent for one or more drops of the bottled liquid to run down from the neck, along the bottle, which is unattractive and which can give rise to soiling of the hands of the user and/or of the surface on which the bottle is then put down (table, tablecloth, etc.).

Various devices have been devised for eliminating or endeavoring to limit that phenomenon.

Some of such devices consist of rings with absorbent material that are positioned around the neck of the bottle. But those structures are often unattractive; they need to be positioned around the neck and to be removed therefrom. In addition, even if they are relatively simple, such devices are nevertheless sources of additional costs.

Another solution to the problem, proposed, for example, in Document GB-754 582, consists in associating the neck of the bottle with a small peripheral lip, which is of square or rectangular section in that document, and that projects outwards.

Unfortunately, in practice, that peripheral lip structure is not very effective and is thus not entirely satisfactory.

BRIEF SUMMARY OF THE INVENTION

Seeking to remedy that drawback, the Applicant has shown that by modifying the structure of such a peripheral lip, it is possible to improve very significantly the effectiveness of the desired non-drip function.

For this purpose, the non-drip device of the invention, for a bottle, is in the form of an outwardly projecting peripheral lip that has a triangular section of thickness that decreases out to an outer tip, said lip being defined by a top side and by a bottom side that, between them, form an angle lying in the range 5° to 45°, and more preferably lying in the range 25° to 35°.

Such a peripheral lip structure almost always prevents drops from forming, and from running down along the bottle after pouring.

The top side of the peripheral lip is advantageously in the form of a plane ring.

According to another feature, the outwardly projecting length of the peripheral lip advantageously lies in the range 0.1 millimeters (mm) to 0.8 mm (and preferably lies in the vicinity of 0.5 mm or of 0.6 mm).

In a particular embodiment, this non-drip device is provided at the top circular edge of a tubular skirt forming a cover of the engagement type for a bottle.

This cover may be obtained in integrally formed manner by molding a plastics material (e.g. by molding high-density polyethylene).

Preferably, the top side of the peripheral lip extends in the plane of the top circular edge of the cover skirt.

According to another feature, the top circular end of the skirt is associated with a closure structure, said top circular end of the skirt and said closure structure being interconnected by means arranged to facilitate separating them (these interconnection means advantageously consist of a plurality of attachment bridges obtained in integrally formed manner).

The closure structure is thus very easy to remove manually or by using a tool, in order to obtain a top end rim for the cover that is clean-cut and attractive (in particular a top rim that is geometrically perfect, and that is coaxial with the neck of the bottle).

In a particular embodiment, the closure structure is in the form of a circular disk, which disk is provided with two side slots, defining between them a pull tab for separating said disk from said skirt.

In a variant embodiment, the closure structure includes an integrally formed stopper, extending coaxially with the skirt in the tubular volume defined by said skirt.

According to yet another feature, the inside face of the cover skirt is provided with means for locking it to a circular ring that is provided at the collar of the bottle, at some distance from the end of the neck.

These locking means advantageously consist firstly of a bottom circular shoulder, designed to come to position itself against the bottom circular rim of the bottle ring, and secondly of a top circular shoulder, or indeed of a plurality of integrally formed lugs distributed over a common circular line, which shoulder or lugs are designed to come to position themselves against the top circular rim of said bottle ring. In this case, from said bottom shoulder, the top portion of the cover skirt advantageously extends upwards with a substantially constant diameter, so as to enable an annular space to be provided between said skirt and the facing portion of the bottle, above the top rim of the ring.

The invention also concerns the bottle having a body terminated by a collar and a neck, which bottle includes a non-drip device as defined above.

According to a first embodiment, the peripheral lip is formed integrally at the neck of the bottle, its top side extending in the plane of the orifice of said neck.

In another embodiment, the bottle is equipped with a cover of the engagement type having its top edge equipped with the peripheral lip of structure of the present invention.

The top edge of the cover skirt, as provided with the peripheral lip, is then advantageously positioned at some distance from the neck of the bottle, so as to optimize the obtaining of the desired non-drip structure.

In a preferred embodiment, the bottle includes an integrally formed circular ring provided at its collar, and some distance from its neck, which ring is defined by a top circular rim and by a bottom circular rim; the associated fitted cover has a closure structure, and the means provided on said cover for the purpose of facilitating separating the skirt from said closure structure, are arranged to form the top edge of the skirt between said top circular rim of the ring and the top end of the neck of the bottle (e.g. at a distance below the plane of the neck of the bottle lying in the range 1 mm to 4 mm).

BRIEF DESCRIPTION OF THE DRAWING

The invention is further illustrated, without being limited in any way, by the following description of two particular embodiments, given merely by way of example and shown in the accompanying drawings, in which.

DETAILED DESCRIPTION OF THE PREFERRED EMBODIMENTS

Figure 1:
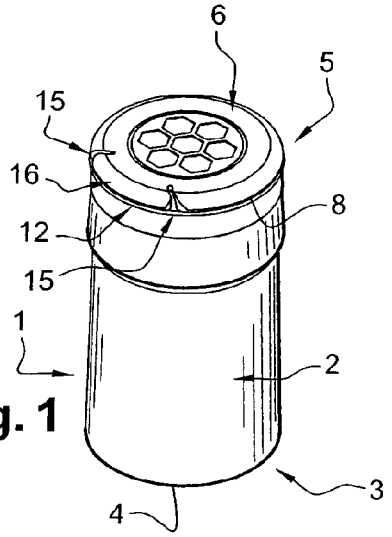
FIG. 1 is a perspective view of a bottle cover of the invention, shown on its own.
Figure 2:
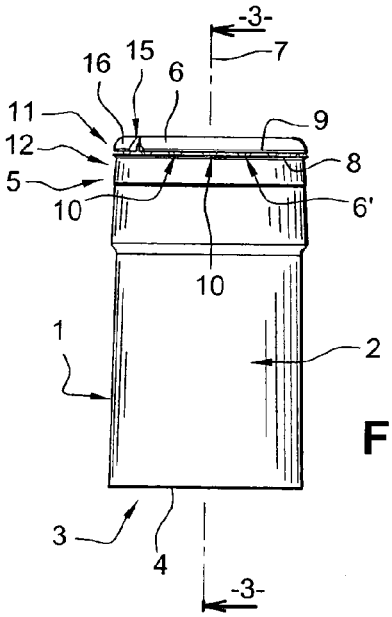
FIG. 2 is a side view of the cover shown in FIG. 1.
Figure 3:
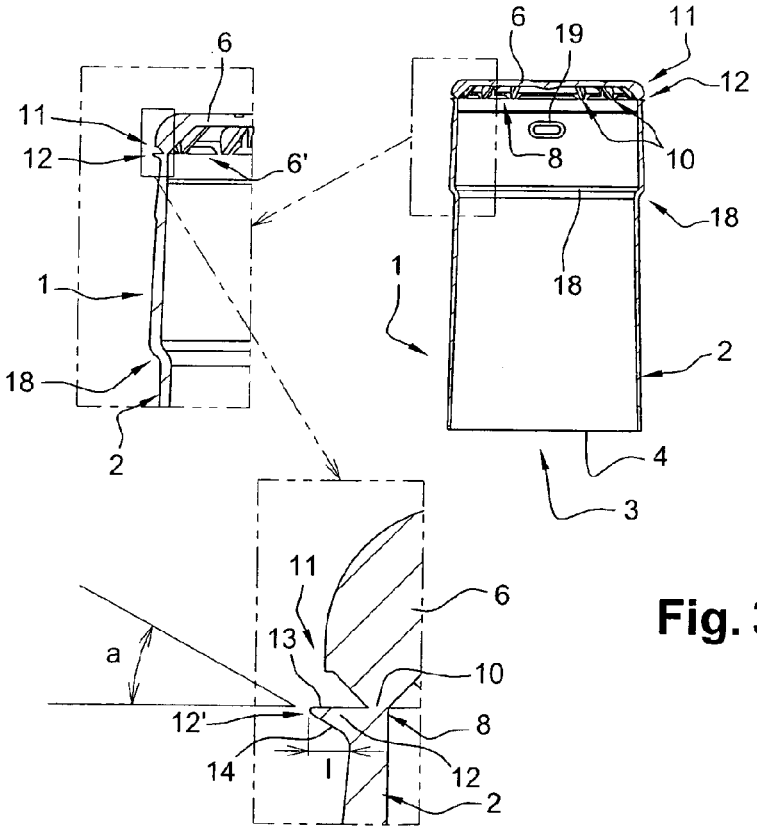
FIG. 3 is a section view on the section plane 3-3 of FIG. 2.

The cover 1 (or cap) shown in FIGS. 1 to 3 is constituted by a tubular skirt 2 having its bottom end 3 defined by a circular edge 4 and its top circular end 5 closed off by a disk 6.

This closure disk 6 is of generally circular shape and extends in a plane that is perpendicular to the axis 7 of the skirt 2.

The skirt 2 and the disk 6 are formed integrally by molding a plastics material, e.g. high-density polyethylene.

The medium thickness of the skirt 2 may be about 0.8 mm; the closure disk 6 then has a medium thickness of about 1 mm. Such thicknesses make it possible to impart good strength to the cover 1 in order to make it easier, in particular, to be fitted by being engaged over the collar of the bottle that is to be equipped with it.

The tubular skirt 2 and the closure disk 6 are interconnected by means adapted to enable them to be separated more easily, in particular in order to enable the disk 6 to be removed easily and in order to obtain a top circular margin 5 for the skirt 2 that is in the form of a clean-cut and geometrically well-defined edge 8.

For this purpose, in the embodiment shown, the top edge 8 of the skirt 2 and the peripheral edge 9 of the disk 6 are secured together by a plurality of integrally formed attachment bridges 10 (the number of bridges lying, for example, in the range 3 to 12, and advantageously in the range 4 to 8).

The interconnection zone 11 between the skirt 2 and the disk 6 consists of a circular line that extends perpendicularly to the axis 7 of the skirt 2 and that is situated at or immediately below the bottom face 6' of the disk 6.

As shown in detail in FIG. 3, the top edge 8 of the skirt 2 is provided with an outwardly projecting peripheral lip 12 that is structured to limit, or indeed to avoid formation of drops when, after pouring, the equipped bottle is returned to its standing position.

This integrally formed lip 12 extends over the entire periphery of the top circular edge 8 of the skirt 2; it has a triangular section, the base of which is connected to the skirt 2, and the thickness of which decreases progressively to the outer tip 12'.

This triangular section is constant over the entire periphery of the lip 12.

The top side 13 of the lip 12 is plane and extends outwards from the top circular edge 8 of the skirt 2, and in the plane of said edge (perpendicularly to the axis 7). Its bottom side 14, which connects the tip 12' to the skirt 2 is plane or substantially plane; it extends in reentrant manner downwards, at an angle a relative to the plane of the top side 13, which angle lies the range 5° to 45° (preferably in the range 5° to 40°, more preferably in the range 25° to 35°, and even more preferably about 30°).

In addition, the length l of the circular lip 12, starting from the outside face of the skirt 2, lies in the range 0.1 mm to 0.8 mm, and preferably lies in the vicinity of 0.5 mm or 0.6 mm.

As explained below, positioning of the circular edge 8 of the skirt 2 is, in this example, adapted in such a manner that, once the cover 1 is put in place on the collar of the bottle, said skirt is not in direct contact with the outside face of the neck.

The positioning of the attachment bridges 10 is also adapted so as not to interfere with the non-drip function of the top edge 8 with its lip 12; in particular, for this purpose, they are preferably provided on the inside of the edge 8 (as can be seen in FIG. 3).

In FIGS. 1 and 2, it can be seen that the side of the closure disk 6 is provided with two side slots 15 that define a pull tab 16 between them. The two side slots 15 may be of length approximately in the range 2 mm to 4 mm. The number and the size of the attachment bridges 10 are adapted to ensure that the skirt 2 and the disk 6 are properly secured together, while also enabling said disk to be removed, by being torn off, using a limited traction force.

The top face of the disk 6 may receive a logo or any other information.

It is advantageously adapted to form a backing zone for receiving a duty stamp (e.g. by pad-printing).

In addition, the inner face of the cover skirt 2 is provided with means adapted to ensure it is locked effectively on the collar of a bottle equipped with a circular ring provided some distance away from its neck. Such ringed bottles are conventionally used in particular for bottling wine.

These locking means, visible in FIG. 3, consist firstly of a bottom circular shoulder 18, and secondly of a plurality of integrally formed lugs 19 distributed over a common circular line that extends parallel to said circular shoulder 18, and that is situated between said circular shoulder and the top edge 8 of the skirt 2. The distance between the shoulder 18 and the lugs 19 corresponds to the width of the bottle ring. It is possible, for example, to provide between three and height integrally formed lugs 19 (in FIG. 3, only one of these lugs is visible).

In a variant embodiment, the lugs 19 may be replaced with a top circular shoulder.

In FIG. 3, it can be seen that the portion of the skirt 2 that extends above the shoulder 18 has a constant or substantially constant diameter up to the top edge 8.

Figure 4:
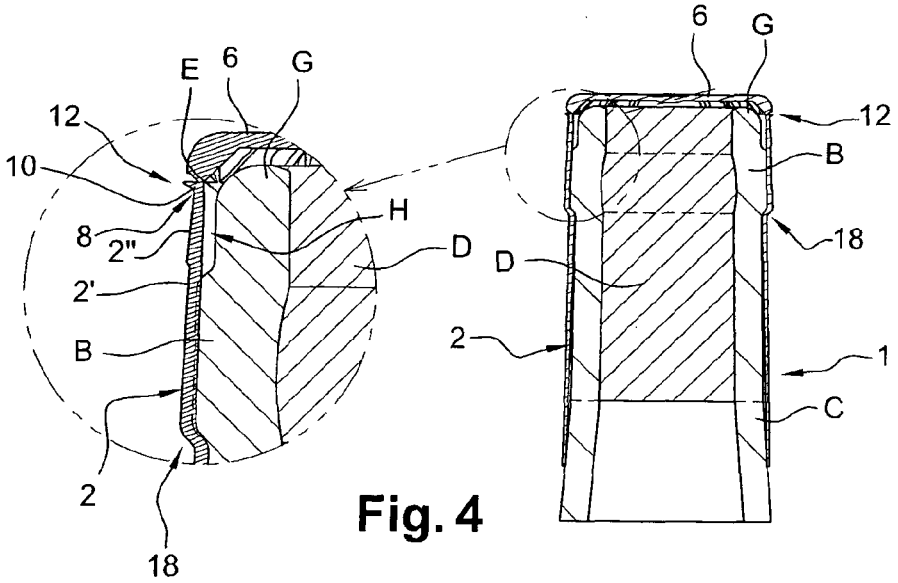
FIG. 4 is a section view showing the cover of FIGS. 1 to 3 as positioned on the collar of a bottle with a stopper.

FIG. 4 shows the positioning of the cover 1 on a bottle that has its collar C terminated by a neck G and that is equipped, at some distance from the top face of said neck G, with an integrally formed ring B.

After bottling the liquid and stopping the bottle using a stopper D, the cover 1 is positioned by force-engagement by means of a suitable tool.

At the end of the force-engagement, the shoulder 18 comes to be positioned against the bottom circular rim of the ring B, and the lugs 19 (or the replacement circular shoulder) come(s) to be positioned against the top circular rim of said ring B. The cover 1 is thus correctly locked on the collar C of the bottle.

As can be seen in detail in FIG. 4, the top edge 8 of the skirt 2, which edge is secured to the disk 6 via the attachment bridges 10, is situated between the top circular rim of the ring B and the top plane of the neck G (this edge 8 equipped with the peripheral lip 12 may advantageously be situated in the range 1 mm under the top plane of the neck G to 4 mm thereunder).

In addition, this top edge 8 of the skirt 2 is positioned at some distance from the neck G (so as to optimize the desired "non-drip" function). In the detail view of FIG. 4, it can be observed that said edge 8 is situated facing the rounded bevel E of the bottle neck G, and that it is separated therefrom by an annular space H. In the example shown, the space H is extended to the top circular edge of the bottle ring B.

For this purpose, as specified above, the wall portion 2' of the skirt 2 that is situated facing the bottle ring B is extended upwards by a top portion 2" of the same diameter, or of substantially the same diameter (whereas the facing diameter of the outside face of the neck G is less than the outside diameter of the ring B).

In order to open the bottle equipped in this way, it suffices to take hold of the tab 16 and to apply upward traction thereon, in order to tear off the closure disk 6 by breaking the attachment bridges 10. It is then possible to remove the stopper D by means of a conventional corkscrew.

Figure 5:
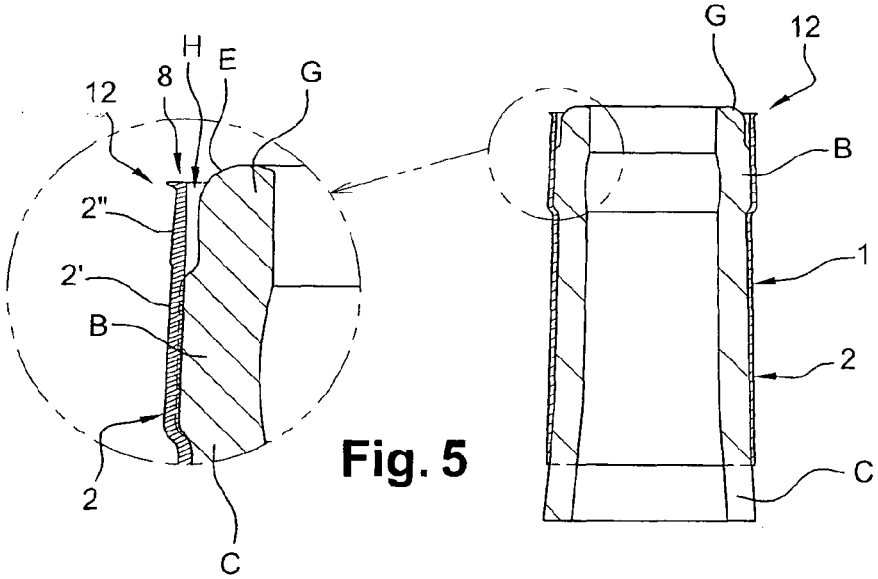
FIG. 5 is a section view of the bottle collar shown in FIG. 4, after the cover closure structure and the stopper have been removed.
Figure 6:
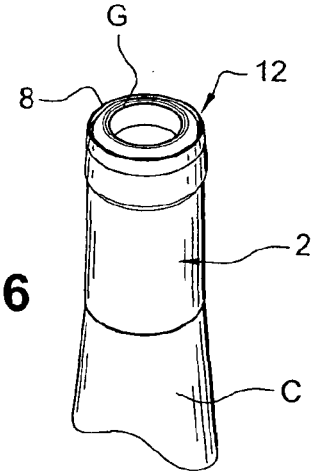
FIG. 6 is a perspective view of the bottle neck shown in FIG. 5.

A bottle is obtained as shown in FIGS. 5 and 6, the collar C of which is equipped with a tubular skirt 2, having a top circular edge 8 equipped with a projecting peripheral lip 12.

This skirt edge 8 associated with the lip 12 provides the above-described non-drip function that makes it possible, in effective manner, to avoid formation of drops that run down along the outside face of the bottle, when said bottle is returned to its standing position after pouring.

In a variant embodiment, the inside face of the top portion of the skirt 2 may be pressed against the bottle (the above-mentioned space H is then removed or minimized).

Such a bottle cap/cover is easy to manufacture and to position; it is attractive both before its closure disk is removed and thereafter, and, in addition, it offers an advantageous non-drip function.

By way of a variant, the simple disk 6 may be replaced with a closure structure equipping an integrally formed stopper, in such a manner as to obtain a full integrally-formed cover-and-stopper assembly equipped with a peripheral skirt having a non-drip function.

In yet another variant, the closure structure 6 may be quite simply removed so as to obtain a cover constituted solely by a tubular skirt, the top edge of which is equipped with a projecting non-drip peripheral lip.

Figure 7:
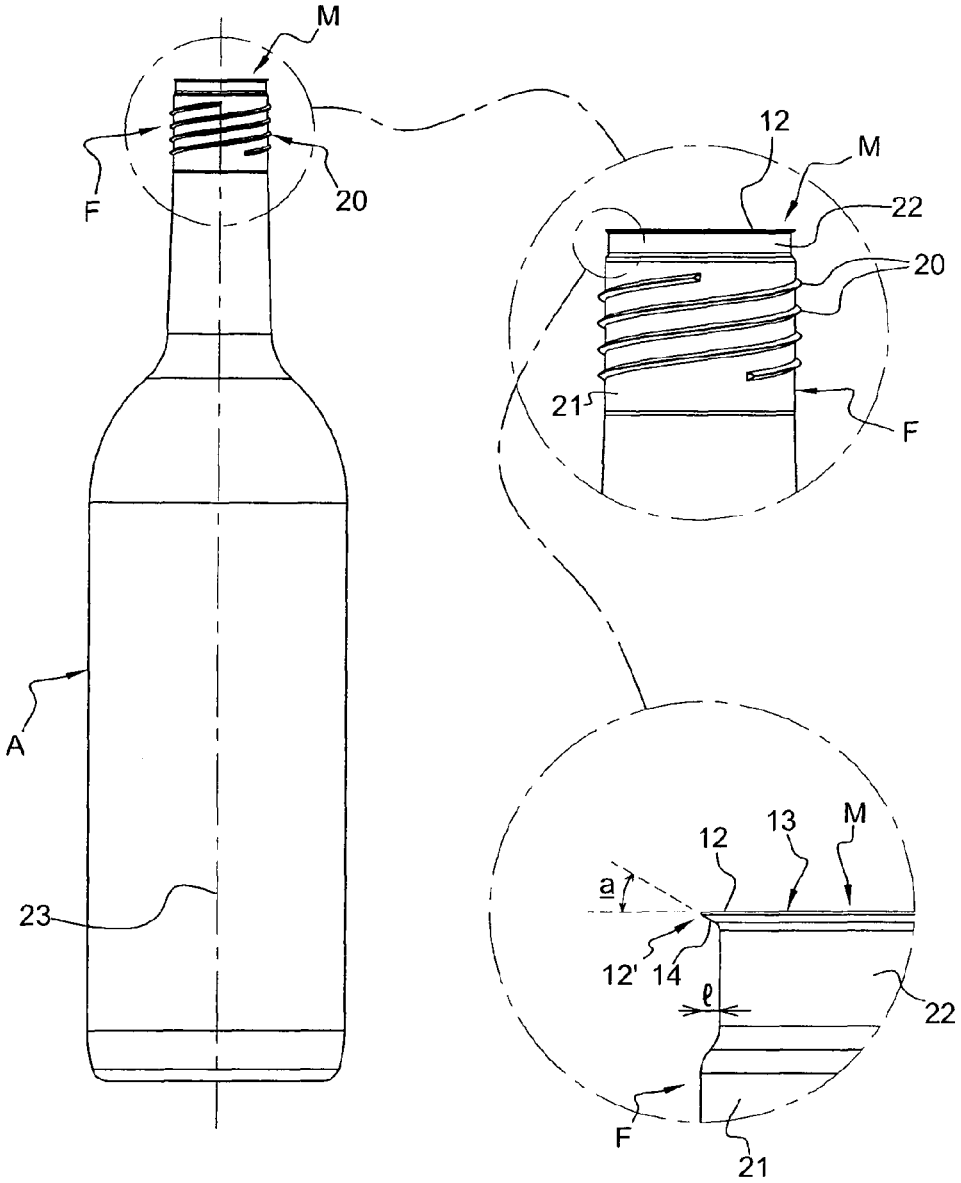
FIG. 7 shows a variant embodiment of the non-drip device of the invention, in the form of an integrally formed lip provided at the neck of a bottle.

In another embodiment shown in FIG. 7, the non-drip lip 12 is integrally formed at the end of the neck M of the collar F of a bottle A.

This bottle A is made by molding a plastics material, e.g. polyethylene terephthalate (PET).

The outside face of its collar F is provided with an integrally formed thread 20, provided on cylindrical portion 21, for receiving a screw cap (not shown).

This cylindrical portion 21 is extended by a cylindrical end portion 22, of smaller diameter, from the free end of which the non-drip lip 12 extends, projecting outwards (provided at the neck M).

This non-drip lip 12 is of structure and of size that are identical to the structure and size described above with reference to FIGS. 1 to 6. It extends over the entire periphery of the neck M and its section is triangular, made up of a top side 13 and of a bottom side 14 that extend on planes forming an angle between them lying in the range 5° to 45° (preferably lying in the range 5° to 40°; more preferably in the range 25° to 35°, and even more preferably about 30°); the length l of said lip 12, going from the outside face of the cylindrical portion 22, lies in the range 0.1 mm to 0.8 mm (preferably about 0.5 mm or 0.6 mm).

The top side 13 of the lip 12 extends in the plane of the orifice of the neck M, perpendicularly to the axis 23 of said neck M.

The difference in diameter between the cylindrical portions 21 and 22 of the collar F of the bottle A is adapted to match the length l of the lip 12, so as not to hinder putting on and taking off the screw cap.

In this embodiment too, such a lip 12 makes it possible almost always to avoid formation of drops that run down along the bottle, after pouring.

The invention claimed is:

1. A cover configured to attach to a bottle, the cover comprising:

a tubular skirt having a bottom end defined by a bottom circular peripheral edge, and a top end defined by a top circular peripheral edge, the top end of the skirt being associated with a closure structure, the top end of the skirt and the closure structure being interconnected by means for separating the top end of the skirt and the closure structure; and a non-drip device including an outwardly-projecting peripheral lip provided at the top circular peripheral edge, the peripheral lip including a triangular section of thickness that decreases out to an outer tip, the peripheral lip being defined by a top side and a bottom side that, between the top side and the bottom side, forms an angle in the range of 5° to 45°.

2. The cover according to claim 1 wherein the angle formed between the top side and the bottom side is in the range of 25° to 35°.

3. The cover according to claim 2, wherein the top side of the peripheral lip is a ring extending in a radial plane with respect to a center axis of the non-drip device.

4. A non-drip device according to claim 2, wherein the outwardly projecting length of the peripheral lip is in the range of 0.1 mm to 0.8 mm.

5. The cover according to claim 1, wherein the top side of the peripheral lip is a ring extending in a radial plane with respect to a center axis of the non-drip device.

6. A non-drip device according to claim 5, wherein the outwardly projecting length of the peripheral lip is in the range of 0.1 mm to 0.8 mm.

7. The cover according to claim 1, wherein the outwardly projecting length of the peripheral lip is in the range of 0.1 mm to 0.8 mm.

8. The cover according to claim 1, wherein the top side of the peripheral lip extends in a plane of the top circular edge of the skirt.

9. The cover according to claim 1, wherein the means for separating the skirt from the closure structure includes a plurality of integrally formed attachment bridges.

10. The cover according to claim 1, wherein the closure structure is in the form of a circular disk, the circular disk being provided with two side slots, defining between the two side slots a pull tab configured to separate the disk from the skirt.

11. The cover according to claim 1, its wherein the closure structure includes an integrally-formed stopper, extending coaxially with the skirt in a tubular volume defined by the skirt.

12. The cover according to claim 1, the wherein an inside face of the skirt is provided with means for locking the skirt to a circular ring that is provided at the collar of the bottle, at a distance from the end of the neck.

13. The cover according to claim 12, wherein the locking means include a bottom circular shoulder configured to position itself against a bottom circular rim of the bottle ring, and a top circular shoulder, or a plurality of integrally formed lugs distributed over a common circular line, configured to position against a top circular rim of the bottle ring.

14. A bottle having a body terminated by a collar and a neck, the bottle including the non-drip device having the peripheral lip according to claim 1.

15. A bottle according to claim 14, wherein the peripheral lip is formed integrally at the neck of the bottom, the top side of the peripheral lip extending in a plane of an orifice of the neck.

16. A bottle, comprising:

a body terminated by a collar and a neck; and the non-drip device in the form of the peripheral lip according to claim 1; and the cover including the tubular skirt having the bottom end defined by the bottom circular peripheral edge, and the top end defined by the top circular peripheral edge, the cover including the non-drip device, the cover being fitted to the collar of the bottle.

17. The bottle according to claim 16, wherein the top end of the skirt of the cover as fitted is positioned at a distance from the neck.

18. The bottle according to claim 16, the bottle including an integrally formed circular ring provided at the collar, at a distance from the neck, the ring being defined by a top circular rim and by a bottom circular rim, the cover having the closure structure, and the means for separating the skirt from the closure structure, the closure structure and the separation means forming the top end of the skirt between the top circular rim of the ring and a top end of the neck.

* * * * *